US005115249A

United States Patent [19]

Homer

[11] Patent Number: 5,115,249

[45] Date of Patent: May 19, 1992

[54] ARRANGEMENT FOR WINDOW SHADE-DEPLOYED RADAR

[75] Inventor: Peter K. Homer, Langhorne, Pa.

[73] Assignee: Grumman Aerospace Corporation, Bethpage, N.Y.

[21] Appl. No.: 573,808

[22] Filed: Aug. 28, 1990

[51] Int. Cl.[5] ..... H01Q 19/06

[52] U.S. Cl. ..... 343/753; 343/877; 343/880

[58] Field of Search ..... 343/753, 877, 880, 915, 343/916

[56] References Cited

U.S. PATENT DOCUMENTS

| | | | |
|---|---|---|---|
| 1,689,400 | 10/1928 | Manley | 343/880 |
| 1,696,402 | 12/1928 | Horton | 343/877 |
| 3,234,556 | 2/1966 | Tanner | 343/753 |
| 4,587,777 | 5/1986 | Vasques et al. | 343/880 |
| 4,660,265 | 4/1987 | Pallmeyer | 29/243.5 |
| 4,771,817 | 9/1988 | Angeloff | 160/266 |

*Primary Examiner*—Michael C. Wimer
*Assistant Examiner*—Hoanganh Le
*Attorney, Agent, or Firm*—Pollock, VandeSande & Priddy

[57] ABSTRACT

A lens assembly for a window shade radar includes two adjacent membranes rolled onto separate rollers. Expandable side masts are pivotally secured to the rollers and the collapsible main beams by slip joints. The main beams enclose wire busses which are directly connected to the membrane modular elements without interposed rotary connections.

6 Claims, 3 Drawing Sheets

ARRANGEMENT FOR WINDOW SHADE-DEPLOYED RADAR

RELATED APPLICATIONS

This invention relates to the technology of copending U.S. patent application Ser. No. 07/580,583 filed Sep. 11, 1990 by the same inventor and assigned to the same assignee.

FIELD OF THE INVENTION

The present invention relates to a space-fed phased array radar antenna, and more particularly to such a radar antenna of the "window shade" type.

BACKGROUND OF THE INVENTION

The prior art includes a "window shade" deployed space-fed phased array radar antenna which is particularly suited for use in space. The unrollable antenna is advantageous because it minimizes storage space aboard a spacecraft. When the spacecraft achieves selected orbit, the antenna is deployed and the "window shade" structure becomes actuated to a fully expanded operative condition. Such an antenna consists of a low-power RF feed which illuminates a lens aperture membrane. Active transmit/receive (T/R) modules in the aperture membrane receive radar pulses from the ground, amplify them, and perform beam-steering phase shifts so that the signal may be re-transmitted toward a target of interest in space. The reflected energy is received in reverse order, being amplified by the T/R modules then focused back onto the space feed. Radar processors and supporting subsystems are located in a bus at the base of a feed mast. A tensioned three-layer membrane constitutes the aperture and provides a very lightweight, yet sufficiently flat, aperture plane. Array flatness requirements for the space-fed approach are less severe than for corporate-fed approaches by an order of magnitude. The membrane aperture can be rolled up onto a drum resulting in a simple, compact, and repeatable method for deployment/retraction of the antenna.

An example of this type of antenna is shown in U.S. Pat. No. 4,771,817 to Angeloff, issued Sep. 20, 1988, to the present assignee.

In an effort to further increase the compact nature of this antenna, a drum arrangement exists which constitutes two separate pivotally connected drums which mount one side of two adjacent membranes. When stowed, the drums collapse against one another so as to reduce the necessary storage length by half. Upon deployment, the drums become arranged in coaxial adjacent fashion and mount one end of the deployed membranes. An opposite end of the membranes is secured to a collapsible end beam which, when deployed, rests parallel to the drum. Means are provided for sealing the seam between the deployed membranes in a shielded fashion. A means for sealing the adjacent antenna membrane edge is disclosed in U.S. Pat. No. 4,660,265 to Pallmeyer and issued Apr. 28, 1987, to the present assignee.

In an improved prior art embodiment shown in FIG. 1, the membrane is supported by two deployed coaxial drums 14A and 14B which are movably mounted to corresponding main beams 18A and 18B. In order to support an opposite end of the antenna membranes two end beams 30A and 30B become deployed. The inclusion of the end beams in addition to the main beams represents a weight and space problem which could be eliminated. Cable connections between the membranes and a bus located in the main beams must be routed to the ends of the main beam through rotary joints at the drum axles. The connections must then be routed back along the drums. This is a significant disadvantage since the cables carry relatively large amounts of DC power and RF signals which may be modified by connectors.

Further, DC power components have to be mounted inside the drums, which requires complicated mounting design and access as well as adequate achievement of thermal control.

The inboard ends of the drums must also be located quite close to each other, typically two inches. However, the inboard ends must also be securely fixed to the main beams. This presents a design dilemma due to the lack of room for structure in this space.

BRIEF DESCRIPTION OF THE PRESENT INVENTION

The present invention effectively alters the construction of a window shade radar antenna by eliminating a separate end beam and simplifies wiring connections. In essence, the design of the present invention is directed to the disposition of two coaxial collapsible drums in deployed parallel spaced relationship to collapsible beams which contain antenna membrane wire bus bars. By structurally eliminating the end beams of the prior art and having a main beam serve both functions of containing a bus as well as supporting the membrane ends opposite the drums, a number of advantages follow.

First, it is possible to directly hard wire the antenna membrane to the bus, thus resulting in shorter path lengths for the wiring. This results in less weight and greater survivability for the resulting structure. Further, this eliminates the need for connectors or rotary joints (e.g., slip rings) at the drum axle as is necessary with the prior art construction.

Also, satellite mass distribution is improved with greater balance being achieved, thereby resulting in significant reduction in attitude control system weight, thrust or force necessary to obtain a desired orbit for the antenna, and antenna distortions caused by thruster firing.

DC power components can also be located in a central main beam bus where thermal control systems already exist.

Structural load paths are more direct, thereby minimizing the tolerance build-up during manufacture.

Finally, the more compact, stowed configuration is advantageous since it requires less storage space in a launch space vehicle.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
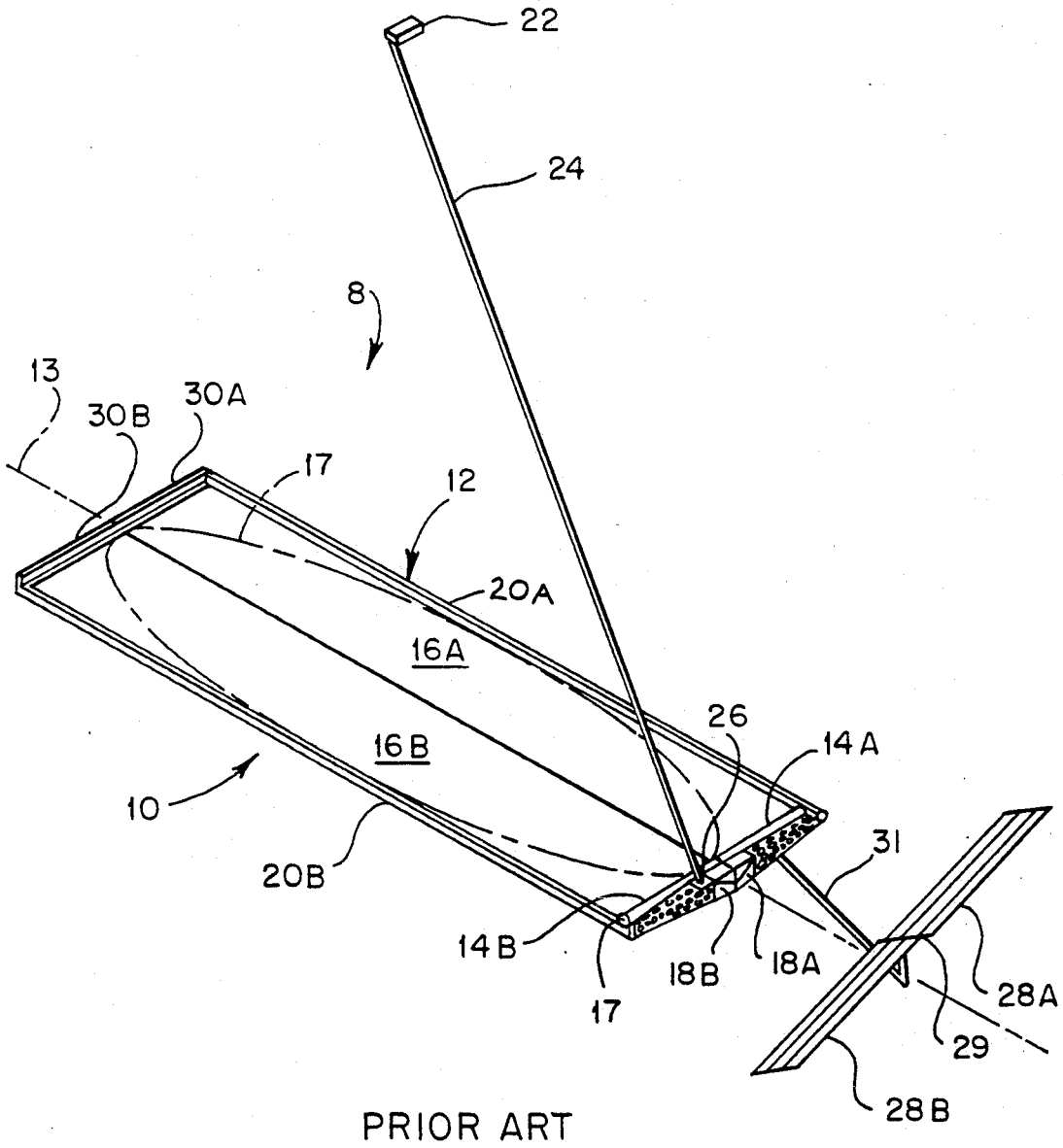
PRIOR ART FIG. 1
FIG. 1 is a perspective view of a prior art window shade radar antenna.

Prior to a discussion of the improved window shade antenna constituting the present invention, it will be instructive to describe a prior art antenna of the type shown in FIG. 1. The antenna is generally indicated by reference numeral 8 and is seen to include two halves 10 and 12 which fold along a center line 13 when the illustrated deployed antenna is stored. When the antenna is deployed, lens aperture membranes 16A and 16B become unrolled from corresponding drums 14A and 14B which are positioned in adjacent coaxial relation. Upon deployment, the side masts 20A and 20B become elongated as the surface of the adjacent membranes 16A and 16B becomes likewise extended. Structural support for the left-illustrated ends of the membranes 16A and 16B is rendered by collapsible end beams 30A and 30B which pivot at the center line 13 for storage. The drums 14A and 14B are rotationally coupled to the corresponding side masts 20A and 20B by means of rotary joints 17, such as slip rings.

In the deployed condition shown in FIG. 1, a feed 22 is positioned at the end of a deployable feed mast 24 which provides wiring between feed 22 and a signal processing unit 26 located in one of the main beams 18A, 18B. Within the main beams 18A and 18B are wire signal busses which interconnect radar elements, located in the membranes 16A and 16B in accordance with designs well established in the prior art. In order to furnish power to the signal processing circuitry in the main beams 18A and 18B, solar arrays 28A and 28B are employed. Power is provided from the solar arrays to the processing circuitry by means of wires mounted to a mast 31. The arrays 28A and 28B are folded relative to a hinge 29 existing therebetween.

When the antenna shown in FIG. 1 is prepared for storage in a space vehicle, the end beams 30A and 30B are drawn toward the drums 14A and 14B. Each drum rolls a corresponding membrane 16A, 16B thereon. The length of the antenna is then effectively halved when the side masts are collapsed and the end beams and main beams are folded along central line 13. This permits compact storage.

Figure 2:
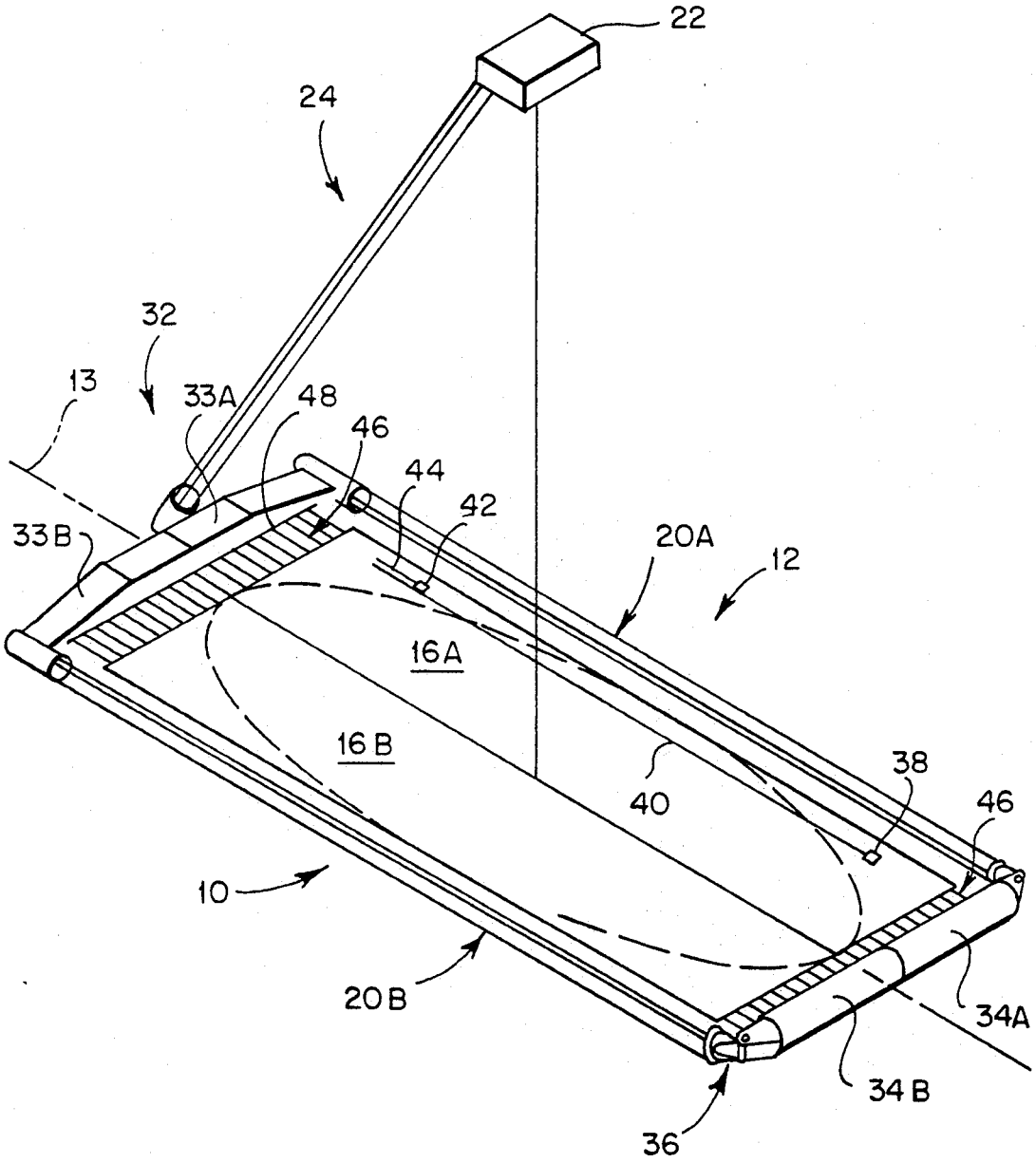
FIG. 2 is a perspective view of the improved window shade radar antenna constituting the present invention.

FIG. 2 is a perspective view of an improvement constituting the present invention. The improved antenna is generally indicated by reference numeral 32 and the same reference numerals are used for identical parts appearing on both FIGS. 1 and 2. As will be appreciated from a review of this figure, the primary structural difference is the elimination of the separate end beams of FIG. 1 and, instead, the left illustrated transverse end of antenna 32 is characterized by foldable main beams 33A and 33B which do not mount the drum members thereon. Instead, the drums 34A and 34B exist at an opposite transverse end of the radar. Each of the main beams 33A and 33B includes a bus 48 for direct connection with ends of hard wires 46 extending from radar elements such as 38 and 42, which are of the type existing in the prior art for conducting signals. Wires 40 and 44 are attached or embedded within the membrane and extend directly outwardly for connection to bus 48. This direct connection avoids complicated commutation through rotary joints between a drum and the bus, as was the case in the prior art.

Figure 3:
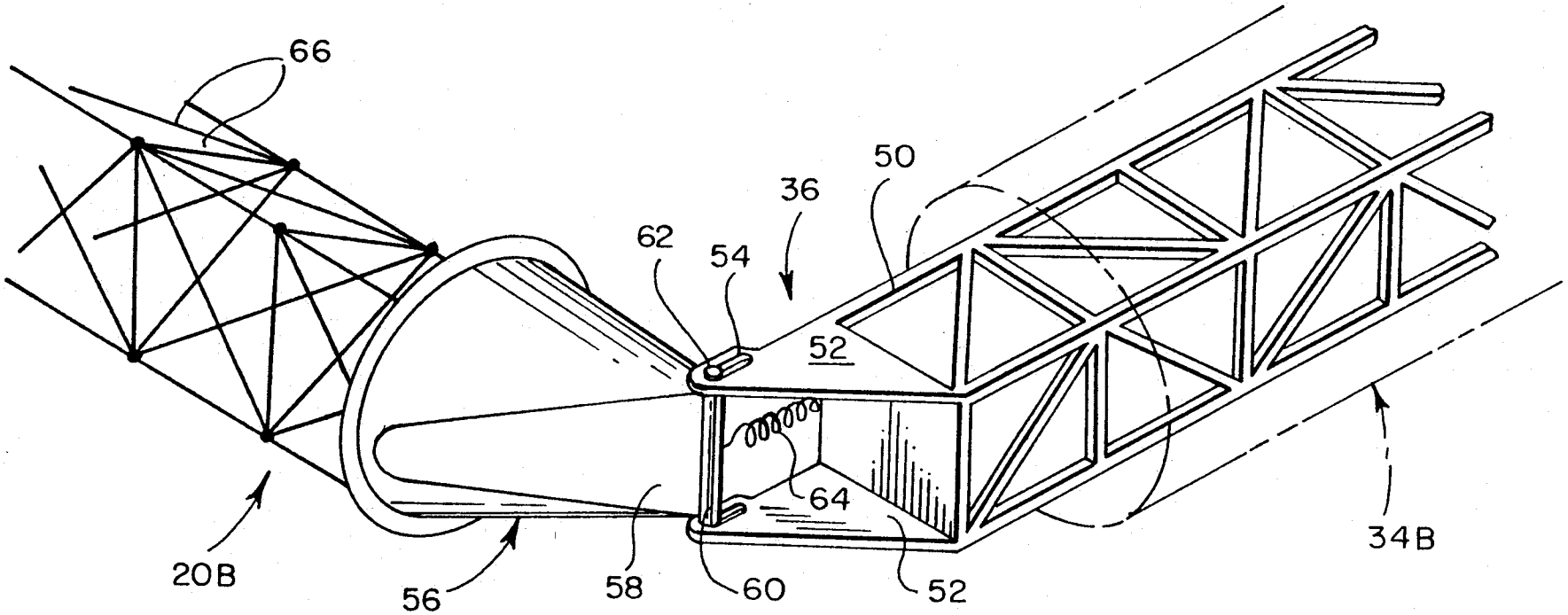
FIG. 3 is a partial perspective view of an end joint connecting a drum axle beam with a side mast of the antenna shown in FIG. 2.

FIG. 3 is a perspective detailed view of the joint existing between the drum 34B and side mast 20B. The drum 34B is shown in phantom and is preferably fabricated from a hollowed honeycomb material (not shown). The hollowed drum is slipped over a core beam 50 which is in the form of a miniaturized truss. The left illustrated end of the truss has two triangularly shaped parallel flanges 52 with elongated slots 54 formed in the apex portion of each. The side mast 20B is capped with a conical member 56 having a truncated surface 58 ending outwardly in a hinge sleeve 60 which is positioned within the elongated slot 54. A hinge pin 62 extends through the sleeve 60 to secure the conical member 56 to the core beam 50 by means of a slip joint 36.

The base of the conical member 56 is attached to the side mast 20B. The side mast is preferably fabricated from longerons which are interconnected wire-like members 66 capable of maintaining tension along the length of side mast 20B after the mast has been deployed by motive means well known to those of ordinary skill in the art. The longerons are particularly adapted to store compactly when the entire radar is stored. A compression spring 64 is attached between the sleeve 60 and the core beam 50 thereby maintaining the slip joint in a biased condition and minimizing the likelihood of vibration between the side masts and the drums This will help prevent vibration in the membranes 16A and 16B so that the membranes may maintain the requisite plane relative to feed 22. As previously discussed in connection with the Background of the Invention, the joint existing between adjacently situated membranes 16A and 16B must be sealed so as to prevent electromagnetic leakage therethrough. The mentioned prior art describes means for achieving this electromagnetic sealing.

Accordingly, as will be appreciated from the preceding description of the invention, an inventive reorganization of components is taught which increases the reliability of a radar and minimizes the weight and storage requirements thereof.

It should be understood that the invention is not limited to the exact details of construction shown and described herein for obvious modifications will occur to persons skilled in the art.

I claim:

1. A collapsible radar lens assembly comprising:

first and second parallel mounted flexible membranes for mounting lens aperture elements thereto;

a first end of each membrane fastened to corresponding first and second hollow collapsible drums for rolling the membranes thereon;

first and second collapsible main beams located in spaced parallel relation to the drums co-linearly arranged when the lens assembly is deployed;

first and second wire signal busses located within respective main beams; and wires for conducting signals directly connected between the aperture elements and the busses thereby avoiding a rotating connection therebetween.

2. The structure set forth in claim 1 together with first and second means for rotationally mounting a corresponding drum; and first and second expandable side mast means respectively connected in between the drums and the main beams for maintaining the membranes in a planar condition when the lens assembly is deployed.

3. The structure set forth in claim 2 wherein each drum mounting means is a truss-like core beam.

4. A collapsible radar lens assembly comprising:

first and second parallel mounted flexible membranes for mounting lens aperture elements thereto;

a first end of each membrane fastened to corresponding first and second hollow collapsible drums for rolling the membranes thereon;

first and second collapsible main beams located in spaced parallel relation to the drums co-linearly arranged when the lens assembly is deployed;

first and second wire signal busses located within respective main beams;

wires for conducting signals directly connected between the aperture elements and the busses thereby avoiding a rotating connection therebetween;

first and second truss core beams for rotationally mounting a corresponding drum; and first and second expandable longeron side masts respectively connected in between the drums and the main beams for maintaining the membranes in a planar condition when the lens assembly is deployed.

5. A collapsible radar lens assembly comprising:

first and second parallel mounted flexible membranes for mounting lens aperture elements thereto;

a first end of each membrane fastened to corresponding first and second hollow collapsible drums for rolling the membranes thereon;

first and second collapsible main beams located in spaced parallel relation to the drums co-linearly arranged when the lens assembly is deployed;

first and second wire signal busses located within respective main beams;

wires for conducting signals directly connected between the aperture elements and the busses thereby avoiding a rotating connection therebetween;

first and second truss core beams for rotationally mounting a corresponding drum;

first and second expandable longeron side masts respectively connected in between the drums and the main beams for maintaining the membranes in a planar condition when the lens assembly is deployed; and a slip joint on outward ends of each core beam and a correspondingly connected side mast, the joint including:

hinge means connected to an end of the side mast;

flanges connected to a mating end of the core beam; and elongated slots formed in the flanges for receiving the side mast hinge means.

6. The structure set forth in claim 5 together with spring means connected between the hinge means and the core beam for minimizing the likelihood of vibration in the slip joint.

* * * * *